US005592138A

United States Patent [19]

Tobben

[11] Patent Number: 5,592,138

[45] Date of Patent: Jan. 7, 1997

[54] INDUCTIVE DEVICE WITH CLAMPING BRACKET

[75] Inventor: Johannes H. Tobben, Eindhoven, Netherlands

[73] Assignee: U.S. Philips Corporation, New York, N.Y.

[21] Appl. No.: 186,732

[22] Filed: Jan. 26, 1994

[30] Foreign Application Priority Data

Feb. 5, 1993 [EP] European Pat. Off. ..... 93200315

[51] Int. Cl.[6] ..... H01F 27/26; H01F 27/30

[52] U.S. Cl. ..... 336/210

[58] Field of Search ..... 336/65, 67, 83, 336/210, 197; 310/217

[56] References Cited

U.S. PATENT DOCUMENTS

| | | | |
|---|---|---|---|
| 2,318,095 | 5/1943 | Putman | 336/210 |
| 3,262,077 | 7/1966 | Wroblewski | 336/210 |
| 3,348,276 | 10/1967 | Miknaitis | 336/210 |

FOREIGN PATENT DOCUMENTS 4029704 3/1992 Germany .

OTHER PUBLICATIONS

Philips Components Data Handbook, Book MA01, 1991, p. 253.

*Primary Examiner*—Thomas J. Kozma
*Attorney, Agent, or Firm*—William L. Botjer

[57] ABSTRACT

The device comprises a winding support (1) which is made of an electrically insulating material and which comprises a coil former (3), provided with a through-opening (9), and a core of a soft magnetic material which consists of two parts (15) and which comprises a limb (19) projecting through the opening of the coil former and a yoke (17) at least partly enclosing the winding support. The two core parts are attached to one another by means of a clamping bracket (21) which is made of a resilient material and which is formed as a closed ring. The construction of the clamping bracket (21) is very inexpensive and it can be very simply mounted on the assembly formed by the core (15) and the winding support (1) in that the clamping bracket consists of one piece of a resilient material which is shaped as a strip comprising barb-shaped free ends (23), which strip is bent so as to form a ring, the facing free ends engaging one another so that the ring is closed. Preferably, the clamping bracket (21) is provided with tags (27) which resiliently bear against the winding support (1) in order to counteract motions of the winding support relative to the core (15).

4 Claims, 3 Drawing Sheets

INDUCTIVE DEVICE WITH CLAMPING BRACKET

Figure 1:
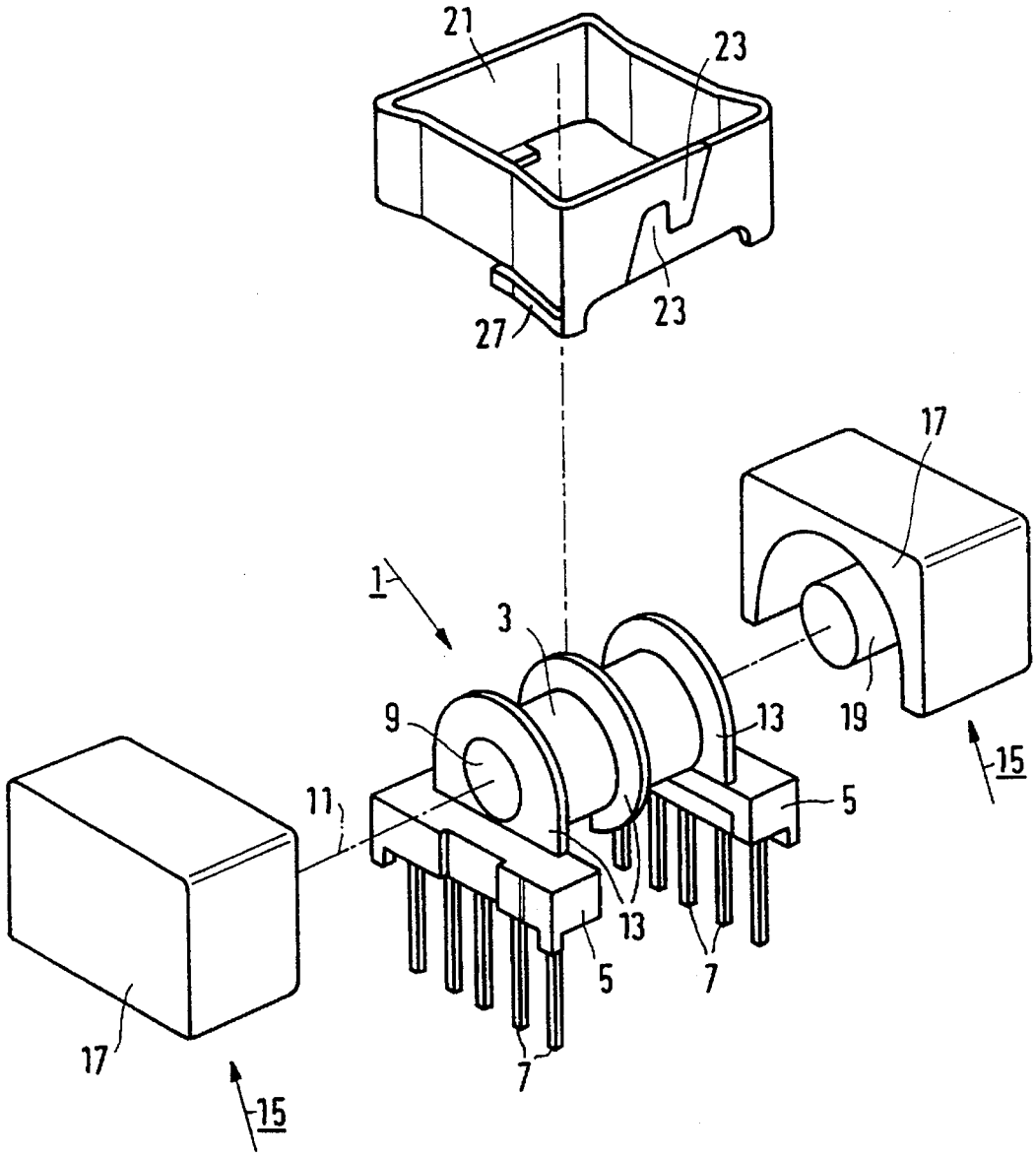

The invention relates to an inductive device, comprising a winding support which is made of an electrically insulating material and which comprises a coil former, provided with a through-opening, and a core of a soft magnetic material which consists of two parts and which comprises a limb projecting through the opening of the coil former and a yoke at least partly enclosing the winding support, said two core parts being attached to one another by means of a clamping bracket which is made of a resilient material and which is shaped as a closed ring.

A device of this kind may be, for example a coil or transformer. An example in this respect is known from Philips Components Data Handbook, Book MA01, 1991, page 253. The clamping bracket of the known device consists of two U-shaped metal strips, projections on one strip being capable of engaging recesses in the other strip. The strips can thus be joined so as to form a substantially rectangular ring which encloses the two core parts in a resilient manner and keeps these parts pressed together. The winding support, provided with windings, is then maintained in position by the limb extending through the opening in the core former and the yoke enclosing the winding support. The existing construction is comparatively expensive, because the manufacture and assembly of the clamping bracket consisting of two parts is comparatively time consuming. Moreover, the winding support will very likely be more or less movable relative to the core, because the process for manufacturing the ferrite cores leads to substantial tolerances in respect of the dimensions of the core parts. If such mobility is undesirable, the winding support is usually glued to the core, leading to a further increase of the costs of the device.

It is an object of the invention to provide an inductive device of the kind set forth whose manufacture is substantially less expensive than that of the known device. To achieve this, the device in accordance with the invention is characterized in that the clamping bracket consists of one piece of a resilient material which is formed as a strip having barb-shaped free ends and being bent so as to form a ring, the facing free ends engaging one another so that the ring is closed. The construction of the one-piece clamping bracket is very simple and inexpensive and its assembly is also particularly simple and not very time consuming, because only the two facing free ends need be pressed against one another until they engage one another and are immobilized around the core.

A preferred embodiment of the invention, in which the problem in respect of mobility of the winding support is also solved, is characterized in that the clamping bracket is provided with tags which engage the winding support in a resilient manner so as to counteract motions of the winding support relative to the core. When the core former is provided with flanges so as to bound the space for the windings, the tags can bear against at least one of the flanges. When the winding support is provided with at least one beam which extends transversely of the axis of the opening and in which connection pins are secured, the tags can bear against the beam.

These and other aspects of the invention will be described in detail hereinafter with reference to the drawing.

Figure 2A:
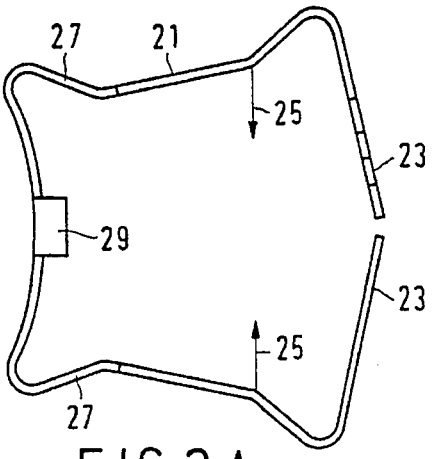
Figure 2B:
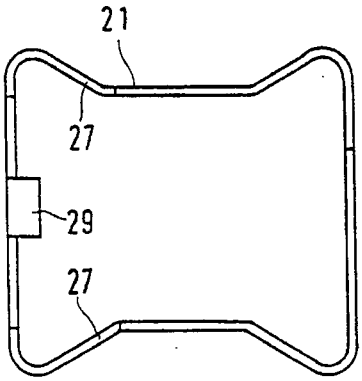
Figure 3A:
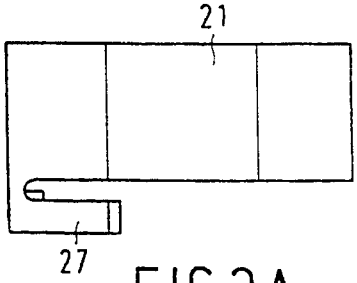
Figure 3B:
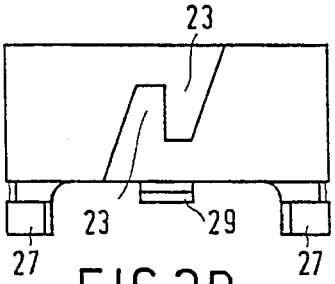
Figure 5A:
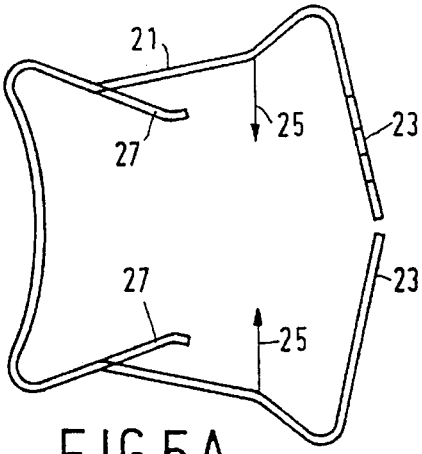
Figure 5B:
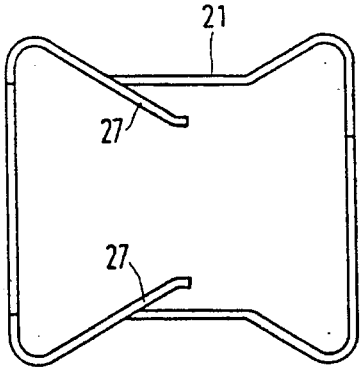
Figure 6A:
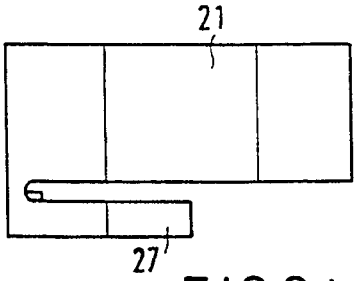
Figure 6B:
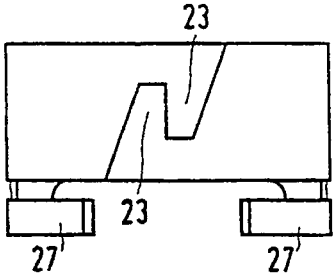
Figure 4:
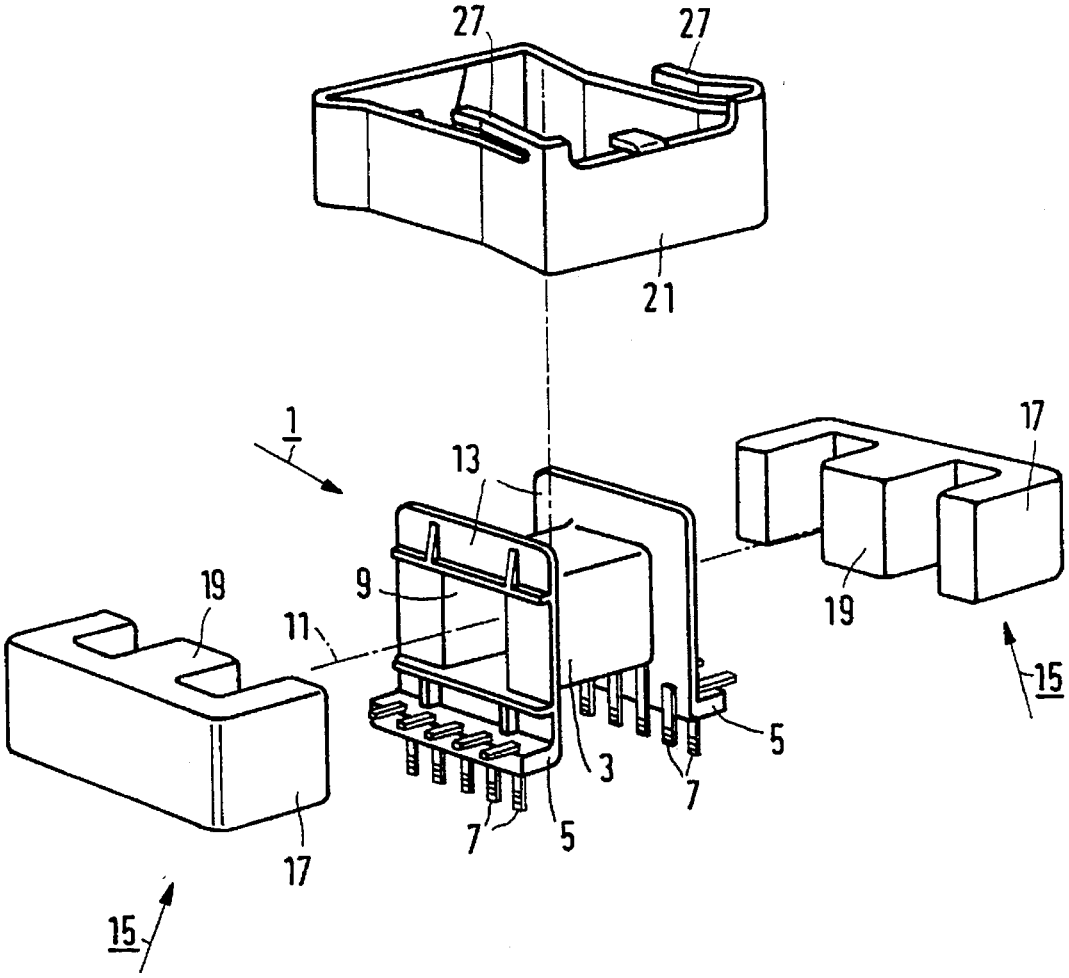

FIG. 1 is an exploded view of a first embodiment of a device in accordance with the invention, FIG. 2A and FIG. 2B are bottom views of a clamping bracket used in the device shown in FIG. 1, in the open and the closed condition, respectively, FIG. 3A and FIG. 3B are a side elevation and an end view, respectively, of the clamping bracket shown in the FIGS. 2A and 2B, FIG. 4. is an exploded view of a second embodiment of a device in accordance with the invention, FIG. 5A and FIG. 5B are bottom views of a clamping bracket used in the device shown in FIG. 4 in the open and the closed condition, respectively, and FIG. 6A and FIG. 6B are a side elevation and end view, respectively, of the clamping bracket shown in the FIGS. 5A and 5B.

The device shown in FIG. 1 comprises a winding support 1 which is made of an electrically insulating material, for example a suitable synthetic material, and which comprises a coil former 3 and two beams 5 in which electrically conductive connection pins 7 are secured. The coil former 3 has a circular cross-section and is provided with a through-opening 9 whose axis 11 is denoted by a dash-dot line. The coil former 3 also comprises a number of circular flanges which extend transversely of the axis 11 and which serve to bound the space available for the windings (not shown) to be provided on the coil former. The device furthermore comprises a core of a soft magnetic material, for example ferrite, which consists of two parts 15. In the present embodiment, each core part 15 comprises a yoke part 17 and a limb part 19, which has a circular cross-section which corresponds approximately to the cross-section of the opening 9. Upon assembly of the device the two core parts 15 are positioned against one another in the position shown, the two limb portions being introduced into the opening 9, thus constituting together a limb projecting through the opening. The yoke parts 17 then together constitute a yoke which encloses the winding support 1 at the upper and both lateral sides. The core parts are then attached to one another by means of a clamping bracket 21 which will be described in detail hereinafter with reference to the FIGS. 2 and 3.

The clamping bracket 21 is made of a strip of a resilient material, for example steel, which is bent so as to form a ring having a substantially square circumference. As is shown in FIG. 2A, the ring is initially open so that it can be readily arranged around the assembly formed by the winding support 1 and the core 15. Subsequently, the free ends 23 of the strip are moved towards one another by squeezing the strip in the direction of the arrows 25. The free ends 23 are shaped as barbs so that they engage one another in response to the squeezing and keep the ring in the closed condition shown in FIG. 2B. The inwards arched side faces of the ring resiliently bear against the core and the clamping bracket 21 keeps the core parts 15 firmly pressed together. The end view of FIG. 3B clearly shows how the free ends 23 engage one another.

Generally speaking, the core parts 15 are manufactured by way of a sintering process which leads to substantial tolerances as regards the dimensions of these parts. Therefore, a comparatively large clearance can readily occur between the limb 19 and the inner wall of the coil former 3. The same applies to the clearance between the yoke 17 and the flanges 13. Consequently, the winding support 1 will exhibit a given freedom of movement relative to the core 15. Such mobility is undesirable in many cases and, therefore, the clamping bracket 21 is preferably provided with resilient tags 27 which, after assembly of the device, resiliently bear against parts of the winding support 1. One of the tags 27 is clearly visible in the side elevation of FIG. 3A. The tags 27 are integral with the strip constituting the clamping bracket 21. In the embodiment shown, at two comers of the clamping bracket 21 there are provided tags 27 which are shaped so that each tag bears against one of the beams 5. If desired, such tags can also be formed at the other two comers of the clamping bracket 21. The height of the beams 5 is only comparatively small and, in order to ensure that the tags are positioned exactly against the beams, the clamping bracket 21 is also provided with an abutment in the form of cam 29 which is bent out of the plane of the strip and which bears against the lower side of one of the core parts 15 upon assembly, thus defining the height of the tags 27 relative to the beams 5.

Analogous to the FIGS. 1, 2 and 3, the FIGS. 4, 5 and 6 show a second embodiment of the device in accordance with the invention. Corresponding parts are denoted by the same reference numerals as used in the FIGS. 1 to 3, even when these parts have a different shape. The two core parts 15 of the second embodiment are E-shaped and the leg 19 has a substantially square cross-section. The winding support 1 of the present embodiment comprises a coil former 3 which has a square cross-section and is provided with a through-opening 9 having a cross-section which is also square. The two flanges 13 provided on the coil former also have a square shape. They project laterally approximately equally as far as the beams 5 and the resilient tags 27 are shaped so that, after assembly, they bear against the upper parts of these flanges. Because the flanges extend over a comparatively long distance in the vertical direction, the present embodiment does not require an abutment 29 to define the vertical position of the clamping bracket 21.

Alternatives can be proposed for the embodiments shown. The clamping bracket 21 can also be used in inductive devices in which the core has a different shape, for example a combination of an E-shaped part and an I-shaped part. If the movability of the winding support 1 is not objectionable, or if the winding support is attached to the core in a different manner (for example, by means of glue), the resilient tags 27 can be dispensed with, thus simplifying the clamping bracket.

I claim:

1. An inductive device, comprising a winding support (1) which is made of an electrically insulating material and which comprises a coil former (3), provided with a through-opening (9), and a core of a soft magnetic material which consists of two parts (15) and which comprises a limb (19) projecting through the opening of the coil former and a yoke (17) at least partly enclosing the winding support, said two core parts being attached to one another by means of a clamping bracket (21) which is made of a resilient material and which is shaped as a closed ring, characterized in that the clamping bracket (21 ) consists of one piece of a resilient material which is formed as a strip having barb-shaped free ends (23) and being bent so as to form a ring, the facing free ends engaging one another so that the ring is closed.

2. A device as claimed in claim 1, characterized in that the clamping bracket (21) is provided with tags (27) which engage the winding support (1) in a resilient manner so as to counteract motions of the winding support relative to the core (15).

3. A device as claimed in claim 2, in which the coil former (3) is provided with flanges (13) extending transversely of the axis (11) of the opening (9), characterized in that the tags (27) bear against at least one of the flanges (13).

4. A device as claimed in claim 2, in which the winding support (1) comprises beams (5) which extend transversely of the axis (11) of the opening (9) and in which connection pins (7) are provided, characterized in that the tags (27) bear against at least one of the beams (5).

* * * * *